US007012479B2

(12) United States Patent
Akiba et al.

(10) Patent No.: US 7,012,479 B2
(45) Date of Patent: Mar. 14, 2006

(54) FILTER CIRCUIT AND TRANSMITTER AND RECEIVER USING THE SAME

(75) Inventors: Naoki Akiba, Tokyo (JP); Eiichi Hase, Tokyo (JP); Ryoichi Itou, Toyko (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 71 days.

(21) Appl. No.: 10/465,593

(22) Filed: Jun. 20, 2003

(65) Prior Publication Data

US 2003/0234700 A1 Dec. 25, 2003

(30) Foreign Application Priority Data

Jun. 21, 2002 (JP) ..... 2002-181543

(51) Int. Cl.
*H01P 5/18* (2006.01)

(52) U.S. Cl. ..... 333/110; 333/204

(58) Field of Classification Search ..... 333/204, 333/205, 219

See application file for complete search history.

(56) References Cited

U.S. PATENT DOCUMENTS 5,703,546 A * 12/1997 Takahashi et al. ..... 333/204
6,052,495 A * 4/2000 Little et al. ..... 385/2
6,108,569 A * 8/2000 Shen ..... 505/210
6,825,742 B1 * 11/2004 Luque ..... 333/204

FOREIGN PATENT DOCUMENTS

JP 03228402 A * 10/1991

* cited by examiner

*Primary Examiner*—James H. Cho
(74) *Attorney, Agent, or Firm*—Bacon & Thomas, PLLC

(57) ABSTRACT

A filter circuit filters unnecessary frequency components within a signal. The filter circuit includes a first and a second line pattern and a closed loop pattern portion. The first line pattern has two ends and one end thereof is connected to an input terminal and the other is opened or grounded. The second line pattern has two ends and one end thereof is connected to an output terminal and the other being opened or grounded. The closed loop pattern portion, which is interposed between the first and the second line pattern, has two or more closed loop patterns and each of the closed loop patterns has an electromagnetic coupling portion coupled to each of the first and the second line pattern.

6 Claims, 8 Drawing Sheets

FILTER CIRCUIT AND TRANSMITTER AND RECEIVER USING THE SAME

FIELD OF THE INVENTION

The present invention relates to a filter circuit and a transmitter and a receiver using the same.

DESCRIPTION OF THE PRIOR ART

FIG. 2 represents a schematic diagram of a conventional filter circuit 200. The filter circuit 200 includes on a planar substrate (not shown) two line patterns 9 and 10 incorporating an input terminal and an output terminal and a closed loop pattern 11 interposed therebetween.

Two line patterns 9 and 10 have two ends, respectively. One end of the line pattern 9 is connected to an input terminal 7 and the other end thereof is open. Similarly, one end of the line pattern 10 is connected to an output terminal 8 and the other end thereof is open. The output terminal 8 is located on the opposite side of the input terminal 7 with respect to a reference line 12, which cuts through the centers of electromagnetic coupling portions between respective line patterns 9, 10 and the closed loop pattern 11.

Referring to FIG. 2, W1 and W2 are dedicated to widths of the line patterns 9 and 10, respectively; W3 and L1 represent a width and a path length of the closed loop pattern 11, respectively; L4 and L5 are respective distance from respective open ends of the line patterns 9 and 10 to the reference line 12; and S1 is a respective distance between the line patterns 9, 10 and the closed loop pattern 11, in which each parameter described is appropriately adjusted to obtain proper filtering characteristics in the filter circuit 200. As for the closed loop pattern 12, e.g., a rounded octagonal shaped loop pattern is employed In the wireless telecommunication system employing the transmitter and the receiver using the filter circuit 200, an attenuation of a transmitting power signal or a receiving power signal within a predetermined pass band, which translates to a deterioration of performance of the wireless telecommunication system should be prevented. Therefore, there is a need for a filter circuit, which permits signals of frequencies within the predetermined pass band to pass with minimal attenuation and signals of frequencies in rejection band, out of the predetermined pass band to reject with maximal attenuation.

Since the conventional filter circuit 200 employs only one closed loop pattern 11 as a resonator, an insertion loss becomes small only near a resonant frequency determined by the path length L1 of the one closed loop pattern 11 but large at other frequencies. Therefore, the pass band that is entirely covered cannot be expanded.

SUMMARY OF THE INVENTION

It is, therefore, an object of the present invention to provide a filter circuit capable of widening a bandwidth of a pass band and reducing an insertion loss in the pass band employed in a wireless telecommunications system.

In accordance with the present invention, there is provided a filter circuit for filtering unnecessary frequency components within a signal, including: a first line pattern having two ends, one of which is connected to an input terminal and the other is opened or grounded; a second line pattern having two ends, one which is connected to an output terminal and the other is opened or grounded; and a closed loop pattern portion, which is interposed between the first and the second line pattern, having two or more closed loop patterns and each of the closed loop patterns having an electromagnetic coupling portion coupled to each of the first and the second line pattern.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
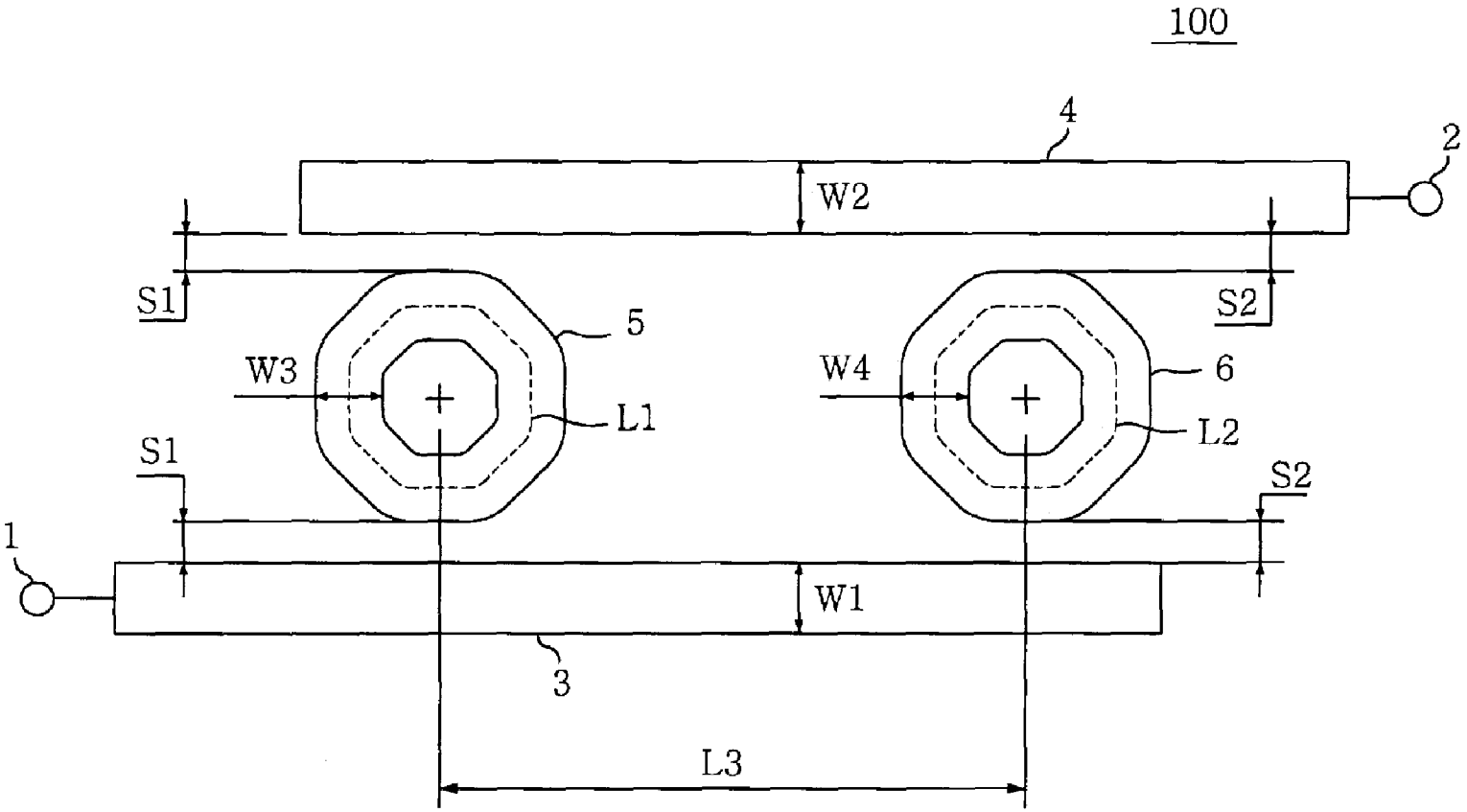
FIG. 1 shows a filter circuit 100 in accordance with a preferred embodiment of the present invention.

FIG. 1 represents a filter circuit 100 in accordance with a preferred embodiment of the present invention. The filter circuit 100 includes two line patterns 3 and 4 on a planar substrate (not shown) and two closed loop pattern 5 and 6 interposed therebetween. Two line patterns 3 and 4 have two ends, respectively. One end of the line pattern 3 is connected to an input terminal 1 and the other end thereof is open. Similarly, one end of the line pattern 4 is connected to an output terminal 2 and the other end thereof is open, wherein the output terminal 2 is located on the opposite side of the input terminal 1 with respect to the two closed loop patterns 5 and 6. Each of the two closed loop patterns 5 and 6 has an electromagnetic coupling portion coupled to the line patterns 3 and 4. The two closed loop patterns 5 and 6 are disposed in such a manner that the distance therebetween is N times of a wavelength at a resonant frequency, N being a positive integer.

Referring to FIG. 1, W1 and W2 represent widths of the line patterns 3 and 4, respectively; W3 and W4 is dedicated to widths of the closed loop patterns 5 and 6, respectively; L1 and L2 show a path length of the closed loop patterns 5 and 6, respectively; L3 represents a distance between the two closed loop patterns 5 and 6; S1 depicts a distance between the respective line patterns 3 and 4 and the closed loop pattern 5; S2 shows a distance between the respective line patterns 3 and 4 and the closed loop pattern 6. As for the closed loop patterns 5 and 6, e.g., a rounded octagonal shaped loop pattern is employed.

The filter circuit 100 in accordance with the present invention and the conventional filter circuit 200 were simulated by using a commercially available high frequency circuit simulator in order to measure insertion loss characteristics of output power signals outputted from the output terminals 2 and 8 when input power signal was inputted to each input terminal 1 and 7.

The details of parameter conditions of the filter circuit 100 for simulation are as follows: a relative dielectric constant and a thickness of the substrate (not shown) are 10 and 0.2 mm, respectively; each of W1 to W3 is 0.199 mm; L1 and L2 are both 1.84 mm; and S1 and S2 are both 0.1 mm; and L3 as in one wavelength of a resonant frequency of 1.84 mm.

On the other hand, the parameter conditions of the filter circuit 200 for the simulation are as follows: a relative dielectric constant and a thickness of the substrate (not shown) are 10 and 0.2 mm, respectively; each of W1 to W3 is 0.199 mm; L1 is 1.84 mm; both L4 and L5 are 0.4275 mm; and S1 is 0.1 mm.

Figure 3:
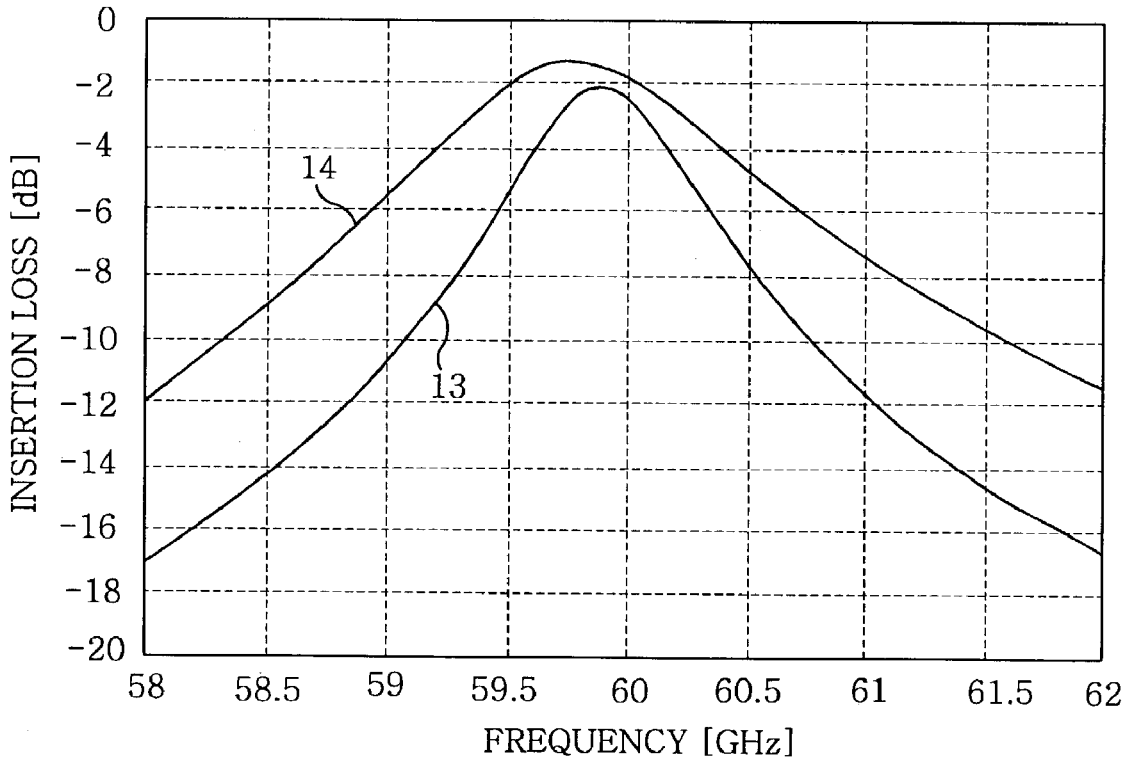
FIG. 3 illustrates the insertion loss characteristics of the filter circuits 100 and 200.

Upon inputting the above listed parameters, the insertion loss characteristics are generated, as shown in FIG. 3. The measured insertion loss characteristics are shown as curves 13 and 14 in FIG. 3. The abscissa represents the frequency in GHz and the ordinate represents the insertion loss characteristics in dB.

The curves 13 and 14 represent the insertion loss characteristics of the filter circuit 100 and the conventional filter circuit 200, respectively, ranging from 58 GHz to 62 GHz. The center frequency of the curve 13 is about 59.9 GHz. Also, assuming that a pass band is denoted to about 3 dB attenuation, the bandwidth of the pass band within about 3 dB attenuation is approximately 0.7 GHz. The insertion loss at the center frequency of 59.8 GHz is about −2 dB.

With respect to the above, the center frequency in the curve 14 is about 59.8 GHz and the bandwidth of the pass band within the 3 dB attenuation is approximately 1.2 GHz. The insertion loss at the center frequency of 59.8 GHz is about −1.3 dB.

As clearly illustrated above, the bandwidth of the filter circuit 100 having the two closed loop patterns 5 and 6 is broader than that of the filter circuit 200 having only one closed loop pattern 11. The insertion loss of the filter circuit 100 having two closed loop patterns 5 and 6 is smaller than that of the filter circuit 200 with only one closed loop pattern 11.

Figure 4:
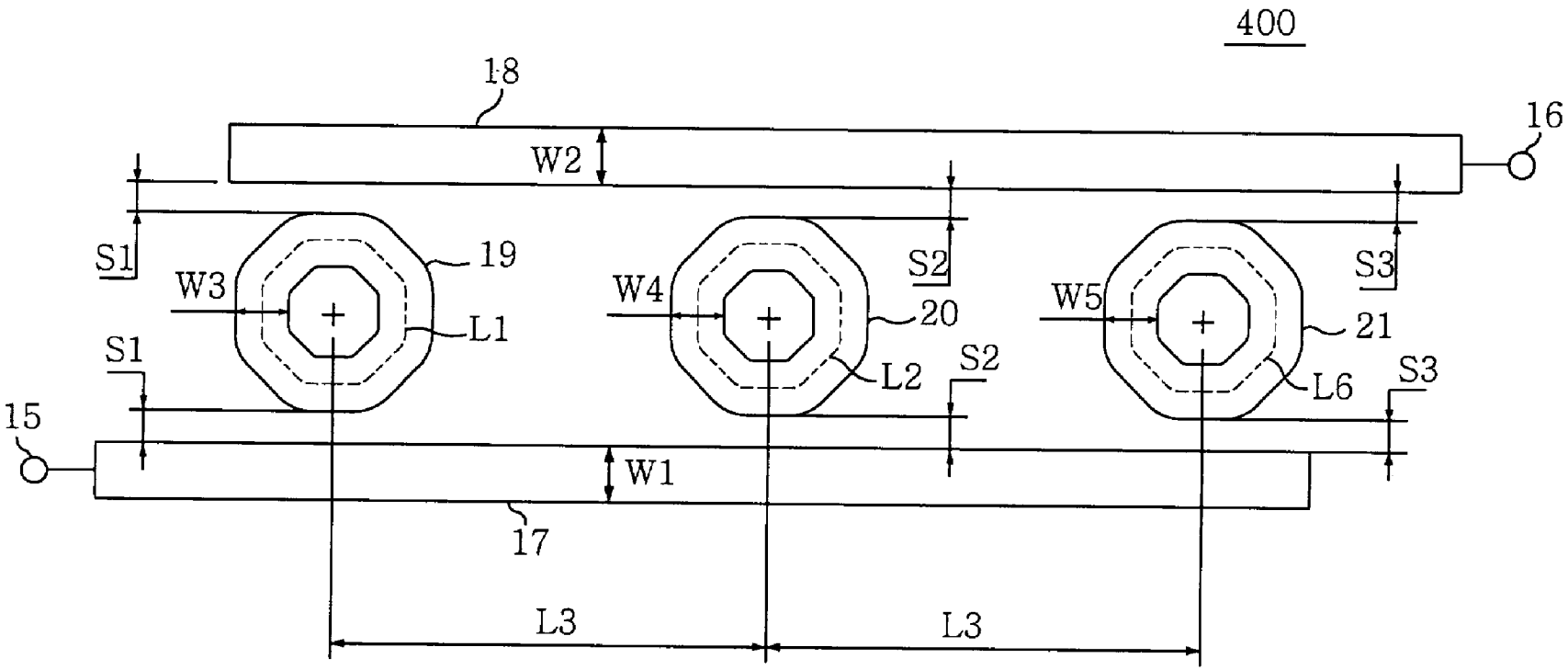
FIG. 4 provides a filter circuit 400 in accordance with another preferred embodiment of the present invention.

FIG. 4 provides a filter circuit 400 in accordance with another preferred embodiment of the present invention. The filter circuit 400 includes two line patterns 17 and 18 on a planar substrate (not shown) and three closed loop patterns 19, 20 and 21 interposed therebetween. The two line patterns 17 and 18 have two ends, respectively. One end of the line pattern 17 is connected to an input terminal 15 and the other end thereof is open. Similarly, one end of the line pattern 18 is connected to an output terminal 16 and the other end thereof is open, in which the output terminal 16 is located on the opposite side of the input terminal 15 with reference to the three closed loop patterns 19 to 21 interposed therebetween. Each of the three closed loop patterns 19 to 21 has an electromagnetic coupling portion coupled to the line patterns 17 and 18. The three closed loop patterns 19 to 21 are disposed in such a manner that the distance between every two neighboring closed loop patterns is N times of a wavelength at a resonant frequency, N being a positive integer.

In FIG. 4, W1 and W2 represent widths of the line patterns 17 and 18, respectively; each of W3 to W5 is dedicated to width of the closed loop patterns 19 to 21, respectively; each of L1, L2 and L6 is a path length of the closed line patterns 19 to 21; L3 represents a distance between the two closed loop patterns 19 and 20 and between the two closed loop patterns 20 and 21; S1 is a distance between the respective line patterns 17 and 18 and the closed loop pattern 19; S2 shows a distance between the respective line patterns 17 and 18 and the closed loop pattern 20; and S3 shows a distance between the respective line patterns 17 and 18 and the closed loop pattern 21. As for the closed loop pattern 19 to 21, e.g., a rounded octagonal shaped loop pattern is employed.

The filter circuit 400 of the present invention shown in FIG. 4 was simulated by using the high frequency circuit simulator in order to measure the insertion loss characteristics of an output power signal outputted from the output terminal 16 when an input power signal is inputted to the input terminal 15. The details of parameter conditions of the filter circuit 400 for simulation are as follows: a relative dielectric constant and a thickness of the substrate (not shown) are 10 and 0.2 mm, respectively; each of W1 to W5 is 0.199 mm; each of L1, L2 and L6 is 1.84 mm; S1 to S3 are 0.1 mm; and L3 is 1.84 mm as in one wavelength of a resonant frequency. The measured insertion loss characteristic is shown as curve 22 in FIG. 5.

Figure 5:
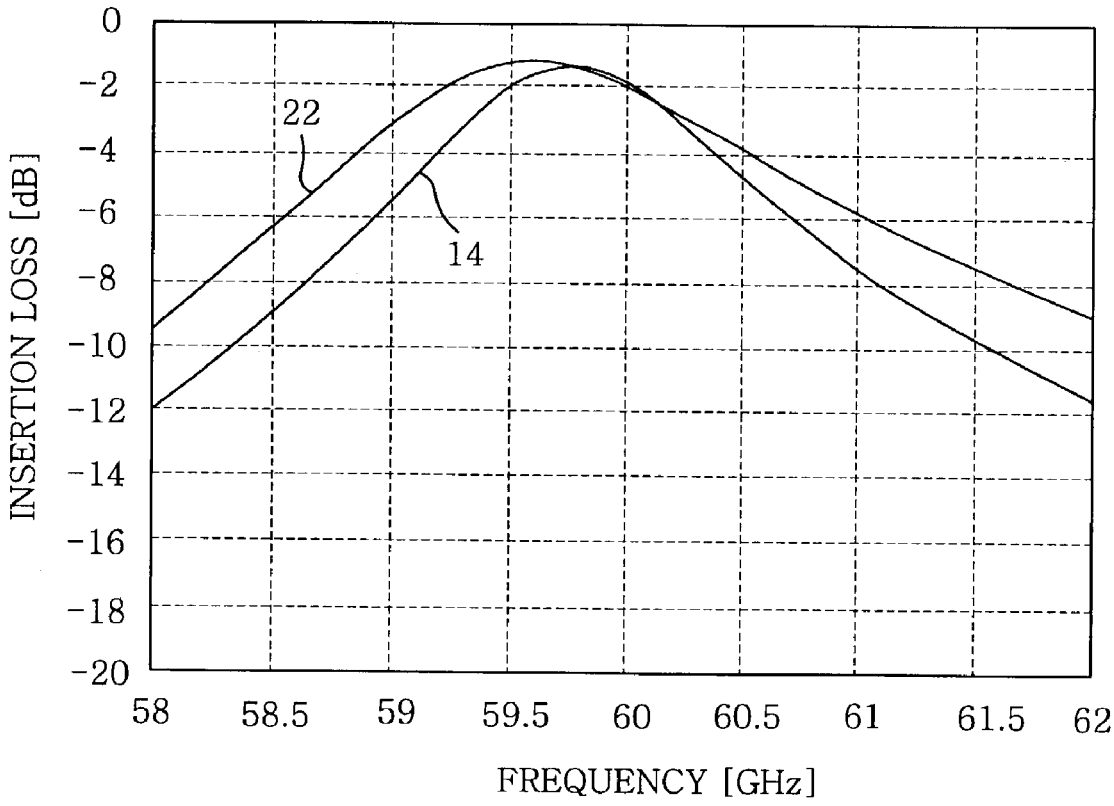
FIG. 5 represents the insertion loss characteristics of the filter circuits 100 and 400.

In FIG. 5, the abscissa represents the frequency in GHz and the ordinate represents the insertion loss characteristics in dB. The curves 14 and 22 represent the insertion loss characteristics of the filter circuit 100 in FIG. 1 and the filter circuit 400 in FIG. 4, respectively, ranging from 58 GHz to 62 GHz. The center frequency in the curve 22 is about 59.6 GHz. Also, assuming that a pass band of the power signal is about 3 dB attenuation, the bandwidth of the pass band within the 3 dB attenuation is approximately 1.7 GHz. The insertion loss at the center frequency of 59.6 GHz is about −1.1 dB. The curve 14, as described above, represents the insertion loss characteristic of filter circuit 100 in FIG. 1.

Comparing curve 22 with curve 14, the bandwidth of the filter circuit 400 having the three closed loop pattern is broader than that of the filter circuit 100 having the two closed loop pattern. In case of the insertion loss, the filter circuit 400 having the three closed loop patterns 19 to 21 has smaller insertion loss than that of the filter circuit 100 having the two closed loop patterns 5 and 6.

Referring again to FIG. 1, considering a case in which the filter circuit 100 given different parameter conditions, e.g., L1 is different than L2, S1 and S2 and L3 the same. The parameter conditions in this case for simulation are as follows: a relative dielectric constant and a thickness of the substrate (not shown) are 10 and 0.2 mm, respectively; each of W1 to W4 is 0.199 mm; L1 is 1.84 mm and L2 is 1.83 mm; S1 is 0.1 mm and S2 is 0.100796 mm; and L3 is 1.835 mm as in one wavelength of a resonant frequency. The measured insertion loss characteristic is shown as curve 23 in FIG. 6.

Figure 2:
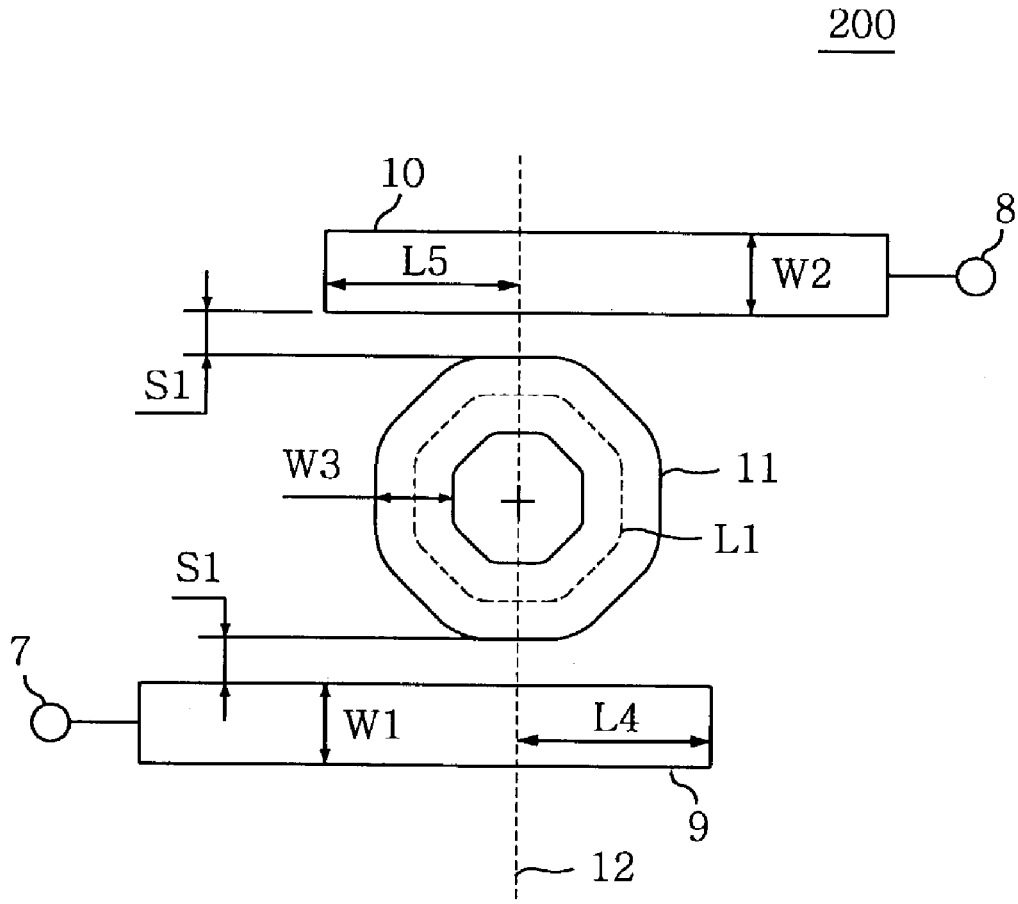
FIG. 2 (PRIOR ART)
FIG. 2 depicts a conventional filter circuit 200.
Figure 6:
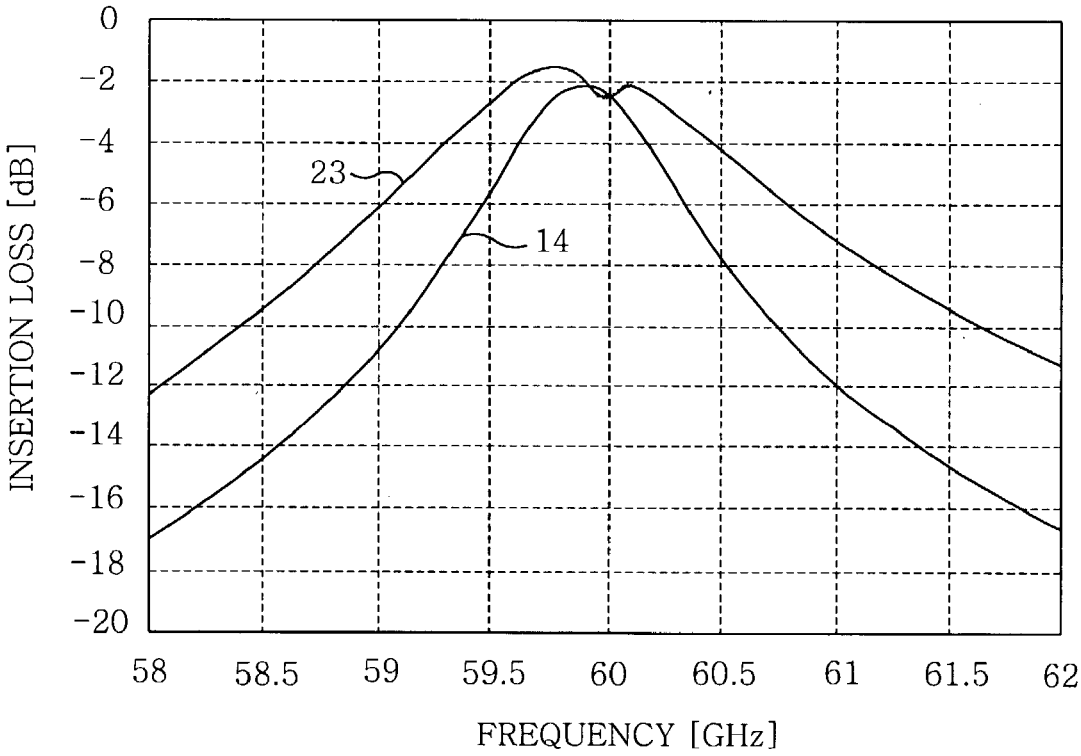
FIG. 6 presents the insertion loss characteristic of the filter circuits 100 and 200 having different conditions.

In FIG. 6, the abscissa represents the frequency in GHz and the ordinate represents the insertion loss characteristics in dB. The curves 13 and 23 represent the insertion loss characteristics of the filter circuit 100 having the different parameters in FIG. 1 and the filter circuit 200 in FIG. 2, respectively, ranging from 58 GHz to 62 GHz. The center frequency in the curve 23 is about 59.9 GHz. Also, assuming that a pass band of the power signal is about 3 dB attenuation, the bandwidth of the pass band within the 3 dB attenuation is approximately 1.3 GHz. The insertion loss at the center frequency of 59.6 GHz is about −1.4 dB. The curve 13, as described above, represents the insertion loss characteristics of filter circuit 200 shown in FIG. 2.

As clearly shown above, the bandwidth of the filter circuit 100 having the two closed loop patterns of the different parameter conditions is broader than that of the filter circuit 200 having only one closed loop pattern 11. In the case of the insertion loss, the filter circuit 100 having the two closed loop pattern 5 and 6 of the different parameter conditions has a smaller insertion loss than that of the filter circuit 200 having the only one closed loop pattern.

Also, in the case of the filter circuit having three or more different closed loop patterns, the same result can be obtained.

Figure 7:
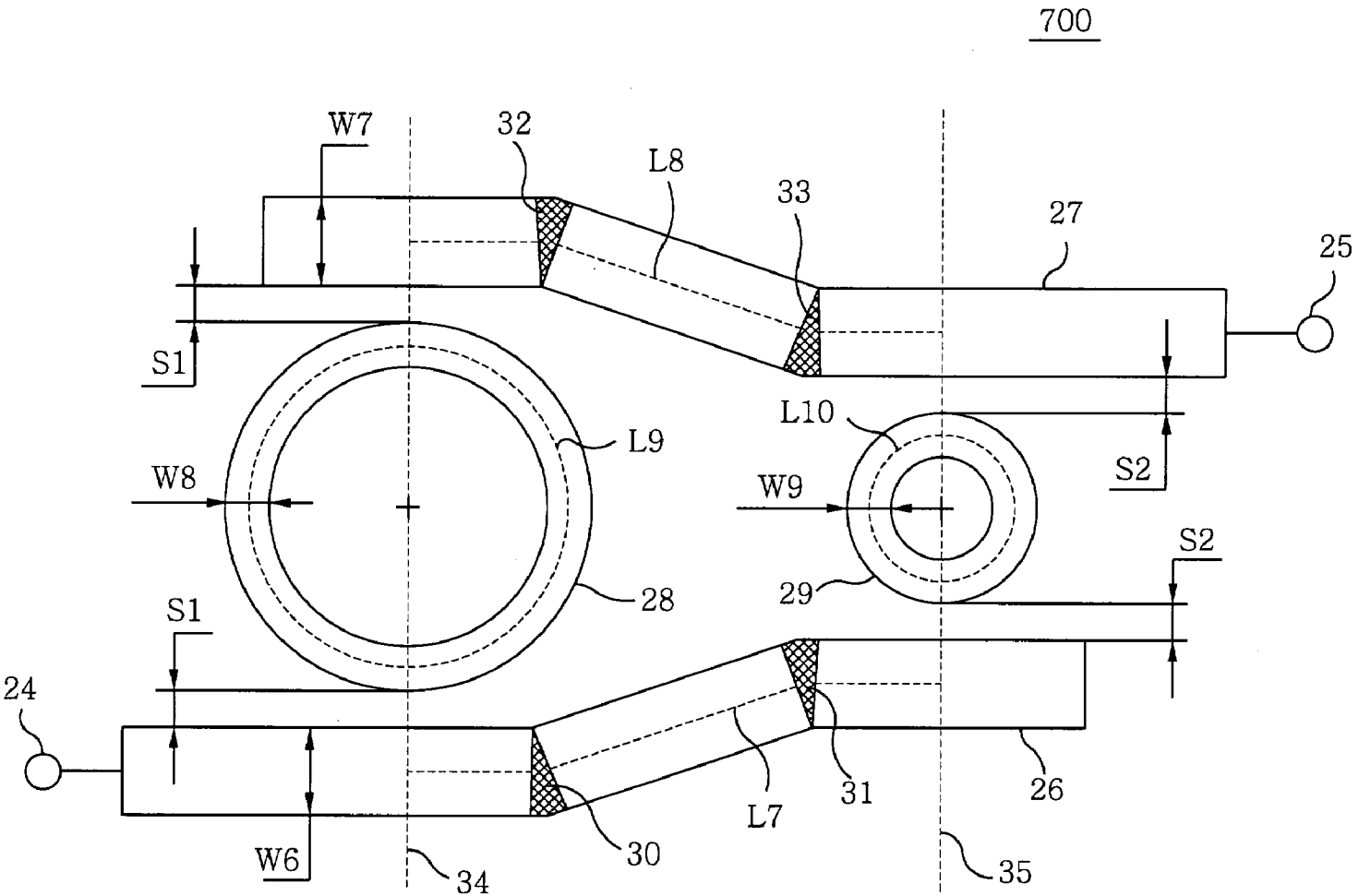
FIG. 7 shows a filter circuit pattern 700 in accordance with still another preferred embodiment of the present invention.

FIG. 7 shows a filter circuit 700 in accordance with still another preferred embodiment of the present invention. The filter circuit 700 includes two line patterns 26 and 27 in which bending parts 30 to 33 are partly inserted, respectively, and two closed loop patterns 28 and 29 interposed therebetween each having different dimensions.

The two line patterns 26 and 27 have two ends, respectively. One end of the line pattern 26 is connected to an input terminal 24 and the other end thereof is open. Similarly, one end of the line pattern 27 is connected to an output terminal 25 and the other end thereof is open, in which the output terminal 25 is located on the opposite side of the input terminal 24 with reference to the two closed loop patterns 28 and 29. Each of the two closed loop patterns 28 and 29 has an electromagnetic coupling portion coupled to the line patterns 28 and 29.

A second reference line 34 passes through a center of an electromagnetic coupling portion between the line patterns 26, 27 and the closed loop pattern 28. Similarly, a third reference line 35 passes through a center of an electromagnetic coupling portion between the line patterns 26, 27 and the closed loop pattern 29.

In FIG. 7, W6 and W7 represent widths of the line patterns 26 and 27, respectively. Similarly, each of W8 and W9 is dedicated to width of the closed loop patterns 28 and 29. S1 is a distance between the respective line patterns 26, 27 and the closed loop pattern 28. Similarly, S2 shows a distance between the respective line patterns 26, 27 and the closed loop pattern 29.

L7 indicates a distance between the second and the third reference lines 34 and 35 along the line pattern 26, and likewise, L8 is directed to a distance between the second and the third reference lines along the line pattern 27. Each of L9 and L10 shows a path length of the closed line patterns 28 and 29. As for the closed loop pattern 28 and 29, e.g., a ring shaped loop pattern is employed.

As shown in FIG. 7, in case that S1 is equal to S2 but L9 is not equal to L10, each of the bending parts 30 and 31 is partly inserted to the line pattern 26 and each of the bending parts 32 and 33 is partly inserted to the line pattern 27. Further, the two distance L7 and L8 between the second and the third reference lines 34 and 35 along with the line patterns 26 and 27 are set in such a manner that the two distance therebetween is N times of a wavelength at a resonant frequency, N being a positive integer. Inserting the bending parts 30 to 33 in the filter circuit 700 shown in FIG. 7, the filter circuit 700 can obtain the similar filtering characteristics with respect to the filter circuit 100 shown in FIG. 1.

Figure 8:
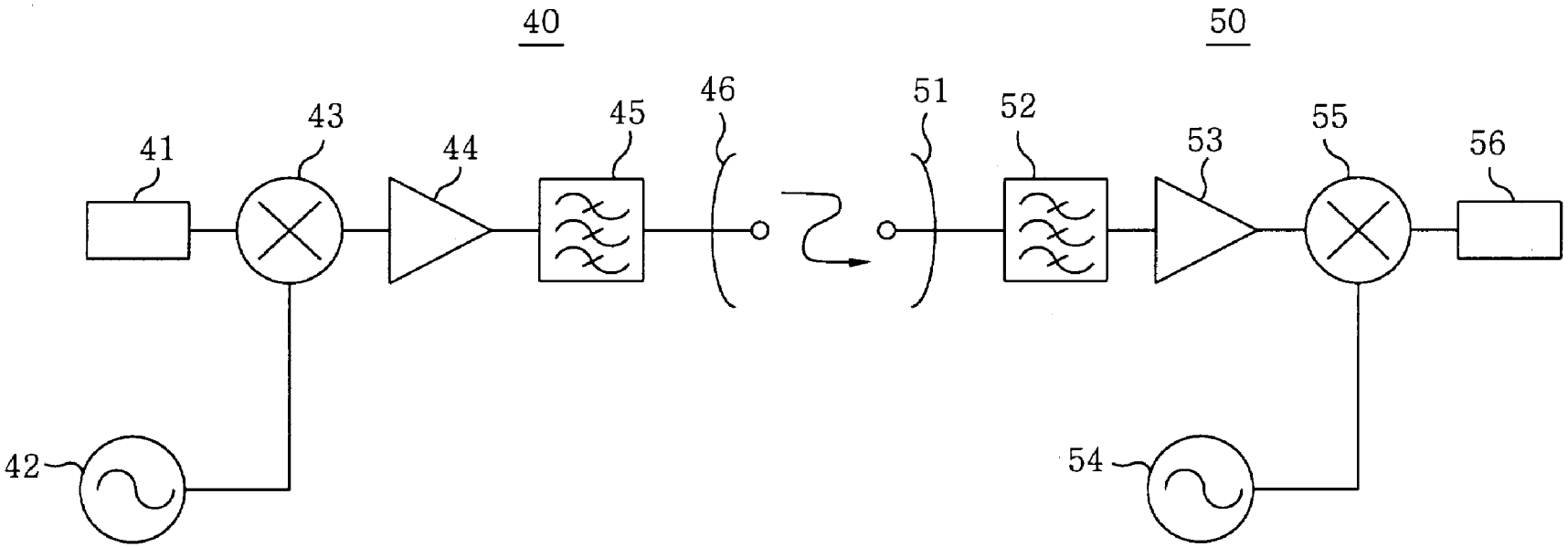
FIG. 8 provides a schematic block diagram of a wireless telecommunication system incorporating a transmitter and a receiver using therein the filter circuit in accordance with the present invention.

FIG. 8 represents a schematic block diagram of the wireless telecommunication system, for example, having a transmitter 40 and a receiver 50. The transmitter 40 has a modulator 41, a local oscillator 42, a mixer 43, an amplifier 44, a filter circuit 45 and an antenna 46. The receiver 50 has an antenna 51, a filter circuit 52, an amplifier 53, a local oscillator 54, a mixer 55 and a demodulator 56.

Referring to FIG. 8, at the time of transmitting, the modulator 41 modulates an information signal to generate a modulated information signal. The local oscillator 42 generates a local oscillation signal and provides it to the mixers 43. The mixer 43 mixes the local oscillation signal with the modulated information signal from the modulator 41 to generate a converted signal. The amplifier 44 amplifies the converted signal and provides it to the filter circuit 45. The filter circuit 45 filters the amplified signal to remove unnecessary frequency component therein. The filtered signal is fed to the antenna 46 and is then transmitted.

At the time of reception, the local oscillator 54, likewise, generates a local oscillation signal and provides it to the mixer 55. On the other hand, a received signal, as received by the antenna 51, is sent to the filter circuit 52. The filter circuit 52 filters the received signal to remove unnecessary frequency component therein. The filtered signal is amplified by the amplifier 53 and is then fed to the mixer 55. The mixer 55 mixes the amplified signal with the local oscillation signal from the local oscillator 54 to generate a mixed signal. The mixed signal is fed to the demodulator 56 and is then demodulated to the information signal.

The filter 45 and 52 in accordance with the present invention can be employed in the wireless telecommunications system and widen the bandwidth and reduces the insertion loss therein.

While the invention has been shown and described with respect to the preferred embodiments, it will be understood by those skilled in the art that various changes and modifications may be made without departing from the spirit and scope of the invention as defined in the following claims.

What is claimed is:

1. A filter circuit for filtering unnecessary frequency components within a signal, comprising:

a first line pattern having two ends, one of which is connected to an input terminal and the other is opened or grounded;

a second line pattern having two ends, one of which is connected to an output terminal and the other is opened or grounded; and a closed loop pattern portion, which is interposed between the first and the second line pattern, having two or more closed loop patterns and each of the closed loop patterns having an electromagnetic coupling portion coupled to each of the first and the second line pattern, wherein the output terminal is located opposite to the input terminal, wherein two or more closed loop patterns are disposed in such a manner that the distance between every two neighboring closed loop patterns is N times of a wavelength at a resonant frequency, N being a positive integer.

2. A transmitter comprising the filter circuit of claim 1.

3. A receiver comprising the filter circuit of claim 1.

4. A filter circuit for filtering unnecessary frequency components within a signal, comprising:

a first line pattern having two ends, one of which is connected to an input terminal and the other is opened or grounded;

a second line pattern having two ends, one of which is connected to an output terminal and the other is opened or grounded; and two or more closed loop patterns disposed between the first and the second line pattern and electromagnetically coupled in parallel between the first and the second line pattern, wherein the output terminal is located opposite to the input terminal, wherein two or more closed loop patterns are disposed in such a manner that the distance between every two neighboring closed loop patterns is N times of a wavelength at a resonant frequency, N being a positive integer.

5. A transmitter comprising the filter circuit of claim 4.

6. A receiver comprising the filter circuit of claim 4.

* * * * *